United States Patent [19]

Smock et al.

[11] Patent Number: 4,868,997

[45] Date of Patent: Sep. 26, 1989

[54] DRYER TIMER

[75] Inventors: Steven W. Smock; Ross G. Helet, both of Indianapolis, Ind.

[73] Assignee: Emhart Industries, Inc., Indianapolis, Ind.

[21] Appl. No.: 208,970

[22] Filed: Jun. 20, 1988

[51] Int. Cl.[4] ..... F26B 21/06

[52] U.S. Cl. ..... 34/53; 338/51

[58] Field of Search ..... 34/53, 55, 45, 46, 48; 338/51, 271, 277, 315, 333

[56] References Cited

U.S. PATENT DOCUMENTS

| | | | |
|---|---|---|---|
| 2,606,986 | 8/1952 | Sweger | 338/271 X |
| 2,768,267 | 10/1956 | Pass | 338/51 |
| 3,296,559 | 1/1967 | Mames | 338/51 X |
| 4,132,008 | 1/1979 | Deschaaf | 34/53 X |
| 4,642,907 | 2/1987 | Best | 34/53 X |

*Primary Examiner*—Harry B. Tanner

*Attorney, Agent, or Firm*—Carl A. Forest

[57] ABSTRACT

A dryer timer includes a housing and a motor and a cam assembly carried in the housing. A switch in the housing is responsive to the cam to switch the motor between a 120 VAC standard timer circuit and a 240 VAC dryer heater circuit. A leadless voltage dropping resistor in the 240 VAC circuit is mounted on the exterior of the housing clasped between the feed-through to the switch and a terminal strap connected to the timer terminal which connects to the dryer heater circuit. A flanged member connected to the feed-through and the terminal strap engaged the flat surfaces of the disk-shaped leadless voltage dropping resistor to dissipate the heat it produces.

7 Claims, 5 Drawing Sheets

DRYER TIMER

BACKGROUND OF THE INVENTION

1. Field of the Invention

The present invention relates to electromechanical timers used in appliance functions and in particular to a dryer timer that incorporates a voltage dropping resistor that enables the timer motor to be operated at two widely differing voltages.

2. Description of the Prior Art

Since automatic clothes dryers were first made, electromechanical timers have been used to time their cycles. These timers are in general similar to the timers used in other appliances, such as clothes washers, and operate on standard 120 VAC. For many years now it has been state-of-the-art in electric clothes dryers to power the motor through the heater during the permanent press cycle. Since the heater operates on 240 VAC, it is necessary to insert a voltage dropping resistor in the circuit between the heater and the motor; otherwise the motor would quickly burn out. Clearly, such a voltage dropping resistor must be able to dissipate large amounts of heat if it is to drop the voltage 120 volts. For this reason, up to now such voltage dropping resistors have been mounted on the interior wall of the dryer cabinet, which acts as a heat sink. The resistor is then connected by a wiring harness to the timer which is mounted elsewhere in the cabinet.

SUMMARY OF THE INVENTION

It is the object of the invention to provide a dryer timer in which the motor voltage dropping resistor is carried on the timer.

It is a further object of the invention to provide a dryer timer that provides the above object and that overcomes one or more disadvantages of the prior art and at the same time is less expensive to manufacture than previous timers and voltage dropping resistors for dryers.

The invention provides a dryer timer comprising: a housing; a motor; cam means driven by said motor and carried in the housing; heat dissipating means carried on the housing; a leadless resistor in thermal contact with the heat dissipating means; electrical switch means carried in the housing and responsive to the cam means for causing electrical current passing through the motor to pass through the resistor when in a first position and to pass through another circuit, not including said resistor, when in a second position; an electrical feed-through connected to the switch, passing through the housing, and electrically connected to the resistor; and an electrical terminal means carried on the housing for connecting the resistor to the heater circuit of a dryer. Preferably at least a portion of the heat dissipating means is integrally formed with the terminal. Preferably, the heat dissipating means further includes a means for clasping the resistor between the portion integrally formed with the terminal and the feed-through. Preferably, the resistor comprises a slug having a pair of parallel, substantially flat sides. Preferably the feed-through comprises a means for attaching a portion of the heat dissipating means to the housing. Preferably the feed-through comprises a rivet. Preferably the resistor comprises an organic resistor or inorganic/ceramic resistor.

The dryer timer according to the invention has been found to eliminate many errors in assembly in prior art dryers. For example, there are many terminals to be connected by wiring harnesses in dryers, and often the wrong terminals are connected. Or since inserting the voltage dropping resistor is a separate dryer assembly step, it is sometimes missed. Both the above errors often result in the timer motor burning up quickly which results in warranty repair calls and customer ill will. The timer according to the invention not only solves these serious problems but also provides a less expensive dryer. In addition, the resistor-dissipator system according to the invention lends itself to an automated assembly procedure which is much more reliable and accurate than the assembly methods associated with the prior art resistors. Numerous other features, objects, and advantages of the invention will become apparent from the following detailed description when read in conjunction with the accompanying drawings.

DESCRIPTION OF THE PREFERRED EMBODIMENT

Figure 1:
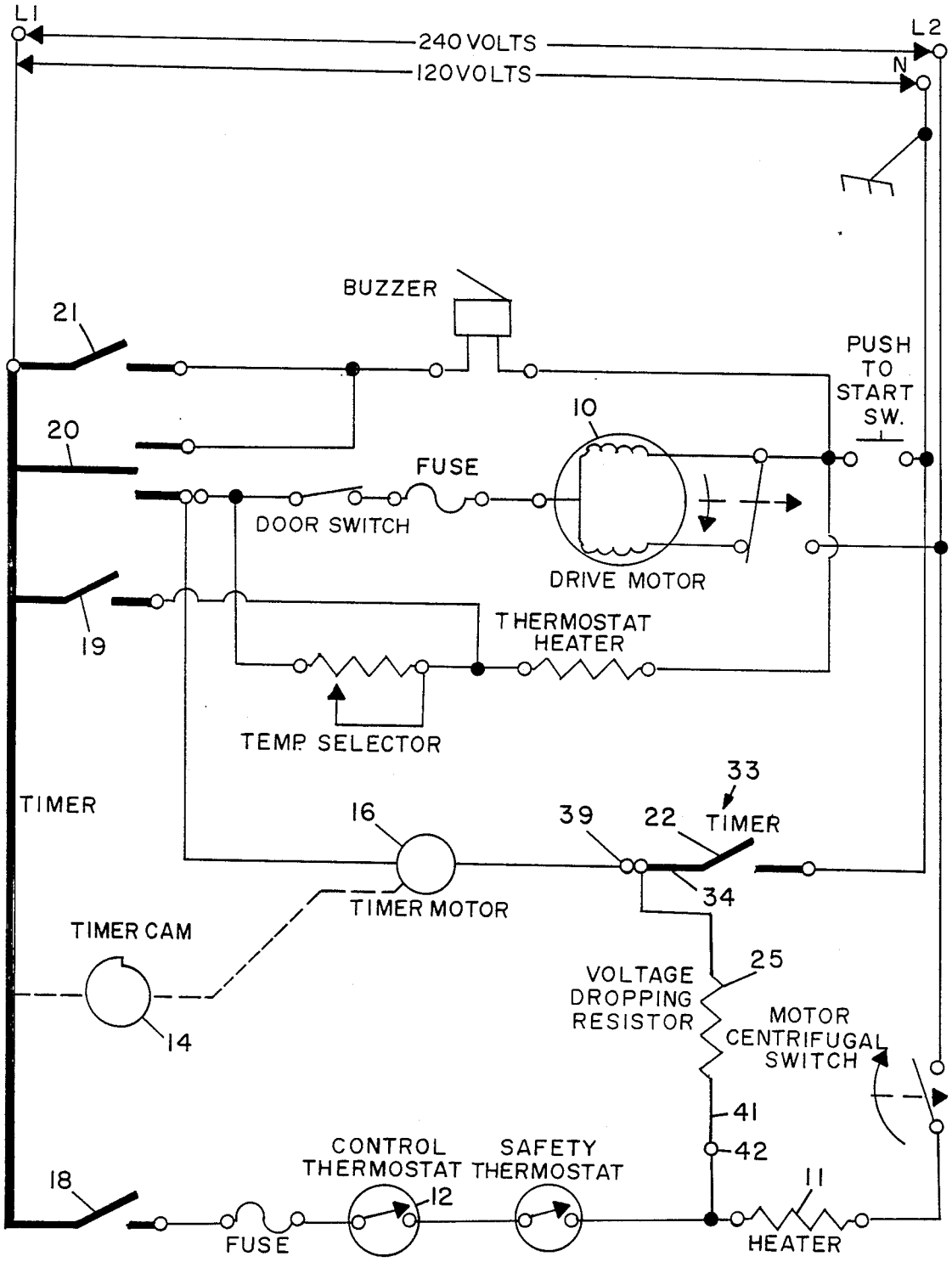
FIG. 1 is a block circuit diagram showing a clothes dryer electrical circuit including a preferred embodiment of the circuit of the timer according to the invention.

The timer according to the invention will be more easily understood when its use is understood, and thus we shall begin by first describing a typical use, making reference to FIG. 1, which shows a block circuit diagram of a preferred embodiment of the invention within the circuit of a conventional automatic electric clothes dryer having a permanent press cycle. It is understood that the use in a dryer and the embodiments of the inventions disclosed are exemplary and are not intended to be limiting of the invention. The conventional dryer shown in FIG. 1 is operated by placing wet clothes in an airtight drum that is made to rotate about a horizontal plane by motor 10. The speed of the drum is sufficient to lift the clothes ¾ the way up the side, and then the clothes fall back to the bottom. A blower pulls room air into the dryer and a heater 11 heats it. This heated air is forced through the tumbling clothes and out the exhaust stack. A thermostat 12 is installed in the exhaust stack that senses the temperature of the exhaust air leaving the drum and controls the power to the heater to dry the clothes according to a programmed drying cycle determined by the timer cam means 14 which is mechanically driven by the timer motor 16 and mechanically drives the timer switches 18, 19, 20, 21 and 22. In a timed cycle switch 20 is closed downward and switch 22 is closed for the entire cycle so that the drum and timer cam rotate throughout the cycle, and switch 18 is closed for nearly the entire cycle, opening near the end to allow the clothes to cool down. In the permanent press cycle switch 22 is open and the drum rotates the entire cycle while the thermostat 12 turns the heater on and off; the time required to dry a load is determined by the size and wetness of the load. To properly dry any size load and any moisture content, it is desirable to connect the timer motor 16 in parallel with the control thermostat 12 and in series with the heater 11. This results in the timer motor 16 being off whenever the thermostat 12 is closed and the heater 11 is on, and the timer motor 16 being on whenever the thermostat 12 is off. Thus, the amount of drying time required to dry the clothes is determined by the thermostat 12. When the clothes are dry, the thermostat 12 opens and the timer motor 16 runs to the end of cycle and shuts off the dryer. To assure a proper cool down, switch 22 closes for the last 15 minutes of the cycle. As a result, the timer motor 16 in such a dryer must operate off of 120 V power sometimes and sometimes off of 240 volt power. This is accomplished by inserting a voltage dropping resistor 25 between the heater 11 and the timer motor 16.

Figure 2:
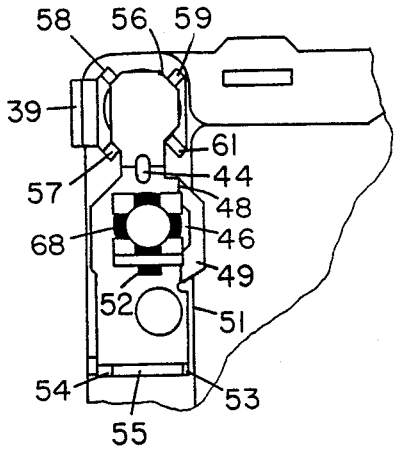
FIG. 2 is a plan view of a portion of the back of a timer housing showing a preferred embodiment of the mounting of the voltage dropping resistor according to the invention.
Figure 3:
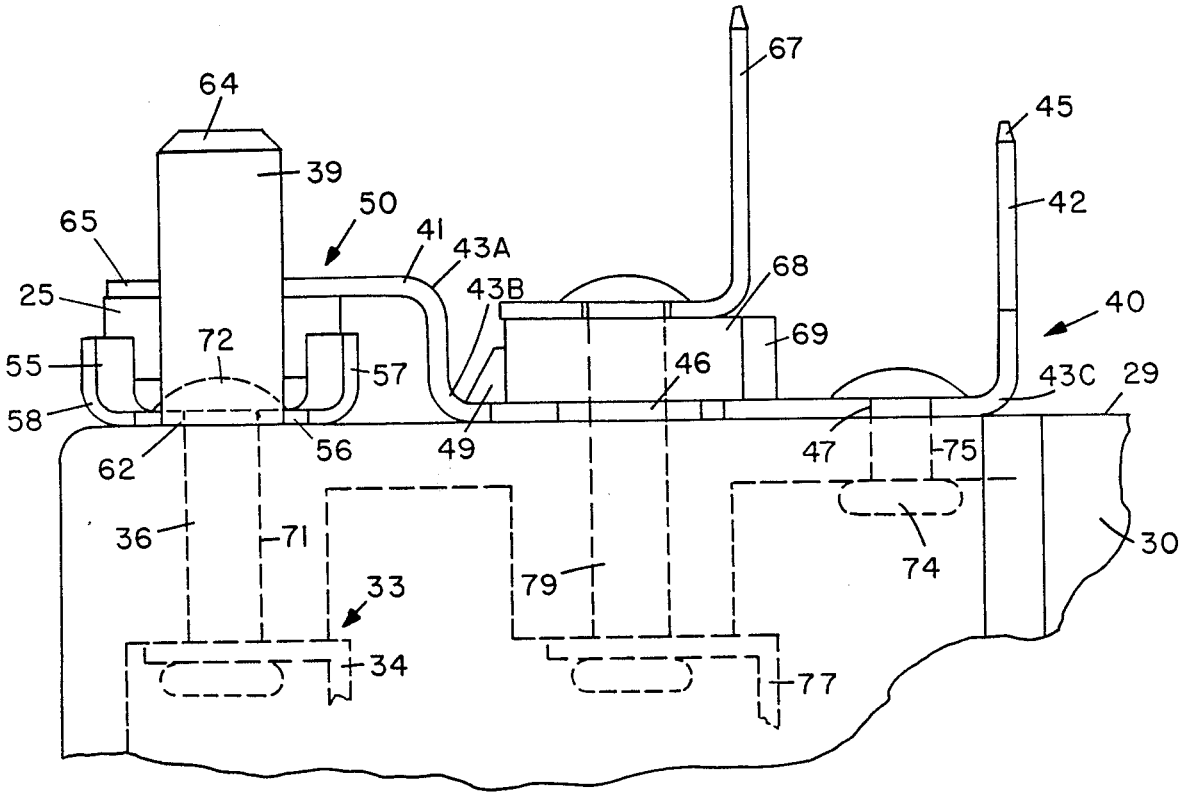
FIG. 3 is a side view of the portion of the timer of FIG. 2.

In FIGS. 2 and 3, the mounting of the resistor 25 on the back 29 of timer housing 30 and its connection to electrical switch means 33 is shown. These FIGS. can best be oriented with FIG. 1 by tracing the connections of FIG. 1 on FIG. 4. The blade 34 of timer 22 is connected via feed-through 36 to terminal 39 and to resistor 25. Terminal 39 is connected to motor 16 via a standard electrical connector and wire (not shown in FIG. 4). The resistor 25 is leadless and is connected via terminal strap 41 to terminal 42 which is connected to the heater circuit in the dryer by a conventional electrical connector and wiring harness (not shown in FIG. 4). Turning now to a more detailed description of FIGS. 2 and 3, a terminal means 40, a heat dissipating means 50, a feed-through 36 and a portion of a switch means 33 are shown. Terminal means 40 is preferably a single piece of metal bent at 43A, 43B and 43C, lanced at 44, and having openings 46 and 47. One side is bent up at 48 to form a flange 49 which fits over a small strap 51 in the conventional housing 30. Opening 46 is generally circular with a notch 52. Shoulders 53 and 54 on terminal 42 act as a stop for a conventional electrical connector. The end 45 of terminal 42 is tapered to make connection easier. All corners, such as 56, are trimmed to prevent sharp edges to reduce the chance of arcing. Heat dissipation means 50 includes a member 55 having a plate 56 with four turned up flanges 57, 58, 59 and 61, a turned up terminal 39, and an opening 62. The end 64 of terminal 39 is tapered. Dissipation means 50 also includes at least end portion 65 of terminal means 40. This embodiment of the timer also includes another terminal 67 which is mounted on an insulating post 68 formed in housing 30. Post 68 is generally circular to fit into opening 46 and includes a key which fits into notch 52. The assembly is manufactured as follows: Member 55 and blade 34 are attached to the housing and electrically connected by feed-through 36, which is a conventional conductive rivet and which passes through bore 71 in housing body 30. Resistor 25 is placed in a locating pen formed by the four posts 57, 58, 59 and 60 of member 55. Terminal means 40 is then placed on housing 30 with opening 46 fitting over post 68 with key 69 fitting into notch 52. Rivet 74 is passed through opening 47 in terminal means 40 and bore 75 in housing body 30 and swagged to fasten the terminal means 40 to the housing. Resistor 25 is clasped between the end 65 of terminal means 40 and the head 72 of feed-through 36. Terminal 67 is then fastened to the housing and another timer switch 77 by rivet 79.

Preferably resistor 25 is about ⅜ inches in diameter by ⅛ inches thick and its contact surfaces are coated with brass. Flanges 57, 58, 59 and 61 are about 0.110 inches high by 0.09 inches wide and are spaced about 0.210 inches from the center of plate 56. Strap 41 is about 1.5 inches long and is about 5/16 inches wide near the terminal end and over the resistor 25 and about ¼ inches wide near the area of bends 43A and 43B, while about 0.5 inches wide in the area of flange 49. Post 68 is about 5/16 inches in diameter by ⅛ inches high. Other dimensions are derivable from those above and the drawings, or are conventional.

Figure 4:
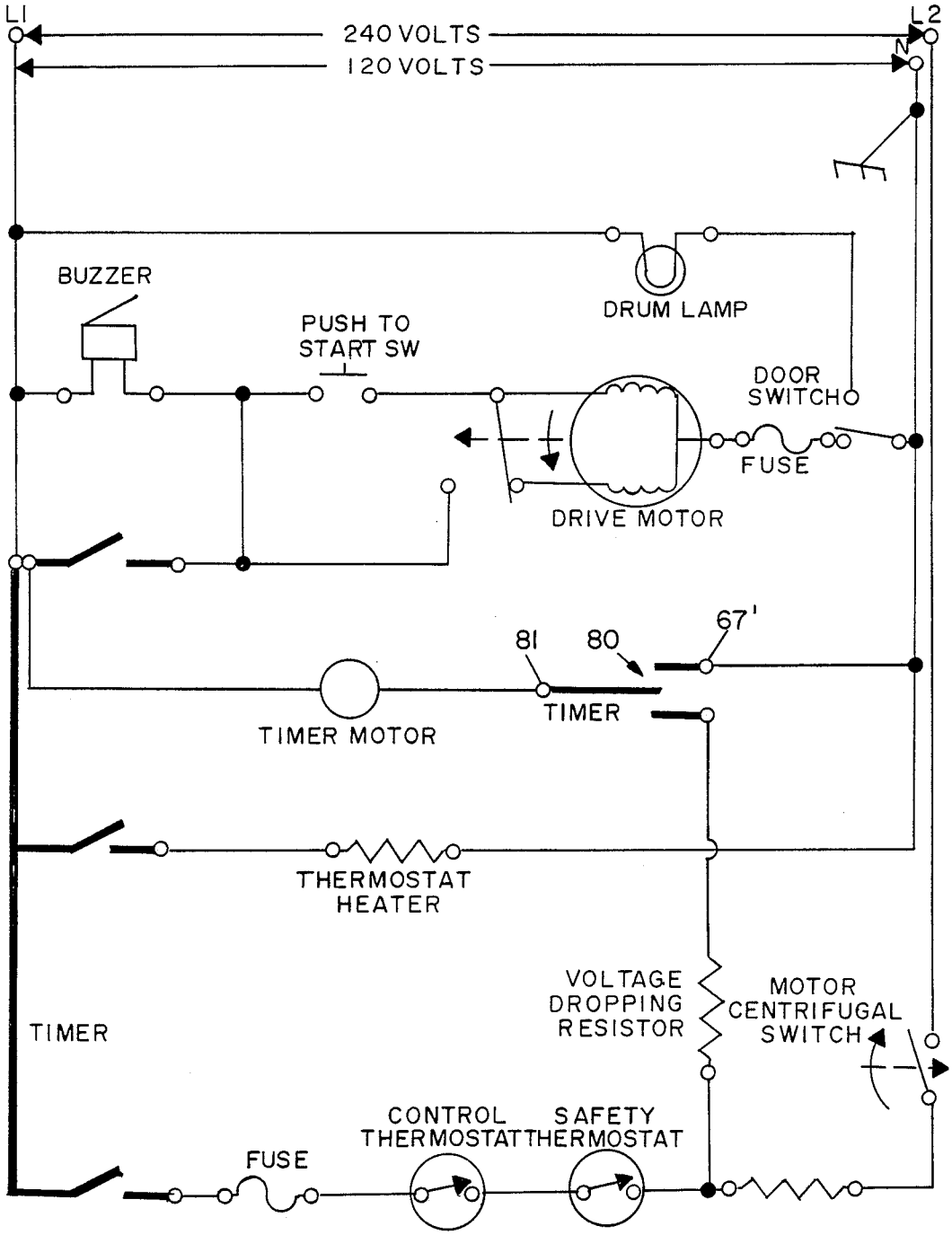
FIG. 4 is an alternative preferred embodiment of the clothes dryer circuit, including an alternative preferred timer circuit according to the invention.

FIG. 4 shows an alternative preferred embodiment of a clothes dryer circuit including an alternative timer circuit. In this embodiment the connection 67 of FIG. 4 is made to the terminal corresponding to 67 of FIG. 3 and the switch 22 is replaced with a single-pole-double-throw switch 80. The motor connection is made on the "T" terminal 81 (not shown in FIGS. 3 and 4 but shown in FIG. 5) which connects to the blade of timer 80, a common timer circuit. This embodiment is presented to indicate that the invention is not limited to any particular dryer or timer circuit.

Figure 5:
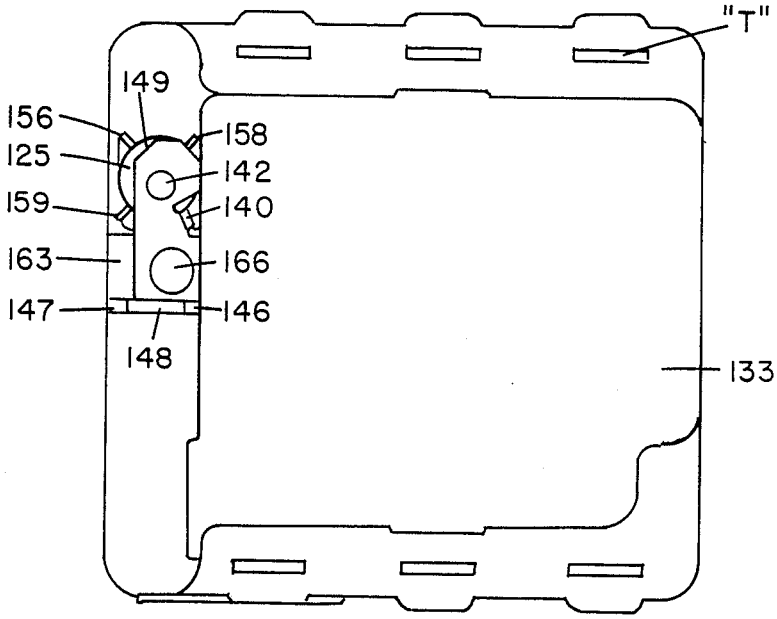
FIG. 5 is an alternative embodiment of the mounting of the voltage dropping resistor on the back of a timer according to the invention.
Figure 6:
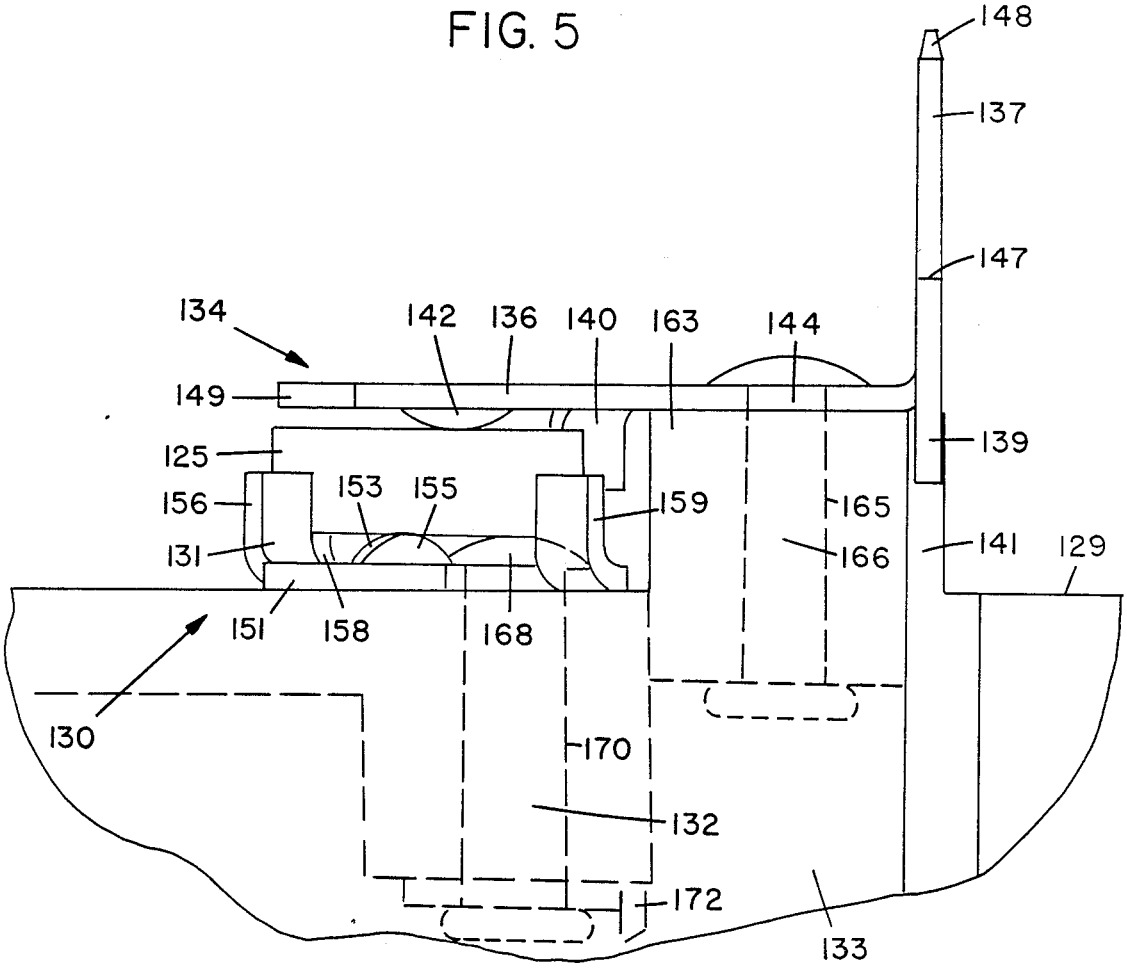
FIG. 6 is a side view of a portion of the timer housing of FIG. 5.
Figure 7:
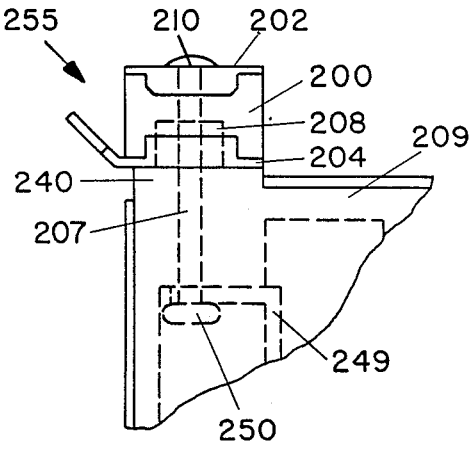
FIG. 7 is a side view of a portion of a timer showing another preferred embodiment of the mounting of the voltage dropping resistor on the back of the timer.
Figure 8:
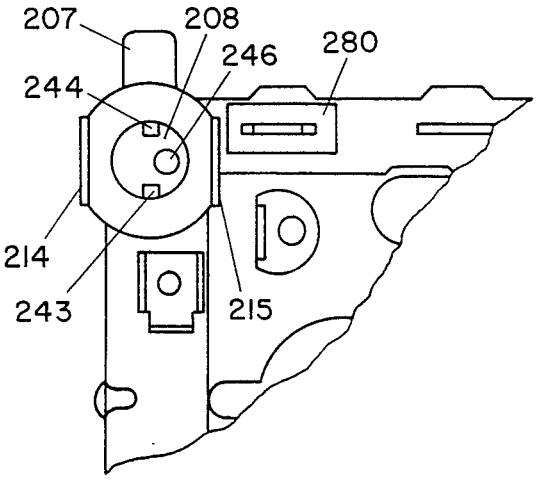
FIG. 8 is a view looking down on the mounting of FIG. 7 with the contact plate over the resistor removed to show the interior structure of the mounting.
Figure 9A:
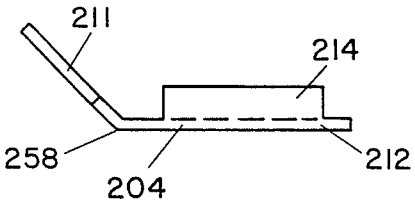
FIGS. 9A and 9B show side and top views respectively of the combination terminal and lower portion of the heat dissipating means of the timer of FIG. 7.
Figure 9B:
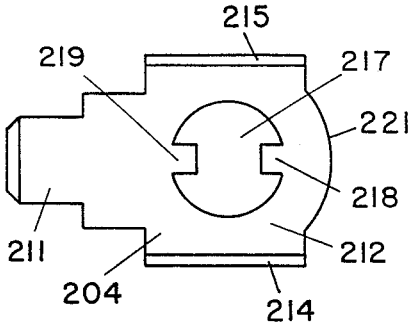
Figure 10A:
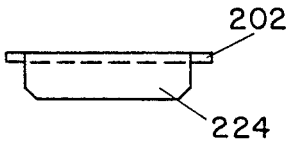
FIG. 10A and 10B show side and top views respectively of the heat-dissipation plate connecting the feed-through and the resistor of FIG. 7.
Figure 10B:
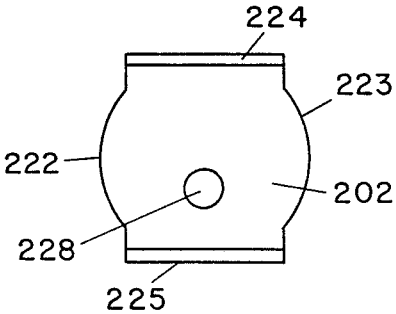
Figure 11A:
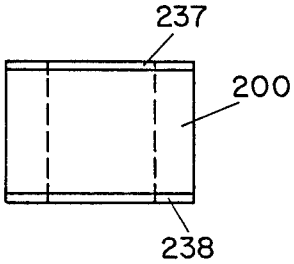
FIGS. 11A and 11B show side and top views respectively of the voltage dropping resistor of the embodiment of FIG. 7.
Figure 11B:
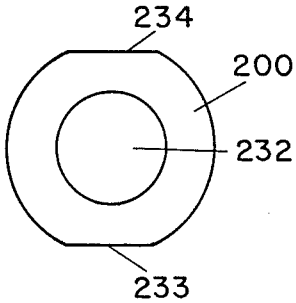

Turning to FIGS. 5 and 6, another preferred embodiment of a timer according to the invention is shown, in which the voltage dropping resistor 125 is connected to what is known as the "fifth circuit" of a standard dryer timer. Again the voltage dropping resistor is leadless and is clasped between feed-through 132 and a portion 142 of terminal means 134. Terminal means 134 is preferably of one piece construction and includes a strap portion 136, a terminal portion 137, two flanges 139 and 140 and a dimple 142. Terminal 137 has shoulders 146 and 147 which act as a stop for the connector to the dryer, and its end 148 is tapered for ease of connection. The corners, such as 149, of strap 136 are trimmed to remove the sharp corners. Strap 136 also includes a hole 144. A heat dissipation means 130 includes a member 31 having a plate portion 151, dimples 153 and 155, and three turned up flanges 156, 158 and 159. Feed-through 132 comprises a rivet 132. Housing 133 is a conventional timer housing that includes a molded seat 163 that is raised above the timer back 129. A bore 165 is formed in the seat 163. Terminal member 134 sits on seat 163 and is held in place by rivet 166 which passes through bore 165 and hole 144. Flange 139 abuts the side 141 of housing 133 to locate terminal member 134. Resistor 125 is located and clasped by flange 140 of terminal member 134, flanges 156, 158 and 159 of heat dissipation member 131, dimples 142, 153, 155 and the head 168 of rivet 132.

The two dimples 153 and 155 and the head of rivet 168 form a three-point seat for resistor 125 and, with dimple 142, ensure good electrical connections to resistor 125. Heat dissipation means 130 primarily includes flanges 156, 158, 159 of heat dissipation member 131, strap 136 and flange 140 of terminal means 134, but also includes the other surfaces of the member 131 and terminal means 134, which together form a relatively large area of good heat conducting material to dissipate the heat produced in resistor 125. Heat dissipation member 131 is held in place by rivet 132 which feeds through bore 170 in housing 133 to also fasten blade 172 of a timer switch to the housing. Preferably resistor 125 is about ⅜ inches in diameter and ⅛ inches thick and its contact surfaces are coated with brass. Flanges 156, 158 and 159 are preferably about 0.110 inches high and 0.09 inches wide and are spaced about 0.210 inches from the center of the plate 151. Strap 136 is about 0.850 inches long and about 0.340 inches wide. Dimple 142 is about 0.150 inches in diameter by 0.025 inches high and placed about 0.62 inches from terminal 137. Terminal 137 is about 0.45 inches high by a quarter inch wide. Flanges 139 and 140 are about 0.10 inches long by 0.08 inches wide. Other dimensions are derivable from those given above and the drawings, or are conventional. This embodiment may be used most easily in combination with the circuit of FIG. 4 but also may be used with other circuits as well.

Turning now to FIGS. 7 through 11B, another preferred embodiment of the mounting of the voltage dropping resistor 200 is shown. The mounting comprises a top plate 202, a bottom-plate-terminal combination 204, a rivet feed-through 207, and a post 208 integrally formed in housing body 209. The voltage dropping resistor 200 is leadless and is clasped between the head 210 of feed-through 207 and a portion of terminal means 204. Terminal means 204 is shown in FIGS. 9A and 9B. It includes a terminal portion 211, a plate portion 212 and a pair of turned-up flanges 214 and 215. Plate portion 212 has an opening 217 in it in the form of a circle with a pair of tabs 218 and 219 extending into the circle. The end 221 of plate 212 is in the form of an arc of a circle. Top plate 202 is shown in FIGS. 10A and 10B. It is generally rectangular in shape with sides 222 and 223 formed in an arc of a circle and having a pair of bent-down flanges 224 and 225. A circular opening 228 is formed in the plate nearer flange 225. Resistor 200 is a hollowed out cylinder with cylindrical bore 232 and flats 233 and 234 along opposing sides of the cylinder parallel to the cylindrical axis. The ends are covered with thin layers 237 and 238 of brass. Housing body 209 is integrally molded with a slightly raised seat 240 and a post 208 formed on the seat. Post 208 is circular with a pair of notches 243 and 244 and a cylindrical bore 246 passes through it. The resistor 200 is mounted as follows. Opening 217 in terminal means 204 is placed over post 208 with tabs 218 and 219 fitting into notches 243 and 244 respectively. Resistor 200 is placed over post 208 with bore 232 fitting snugly on the post and with the flat sides 233 and 234 fitting snugly between flanges 214 and 215 respectively on terminal means 204. Plate 202 is placed over the resistor 200 with flanges 224 and 225 fitting snugly over flat sides 233 and 234 respectively. Rivet 207 is placed through opening 228 in top plate 202 and passes through bore 246 in housing body 209. A switch part 249 is placed over the end of rivet and the end is clinched to hold the mounting assembly together and to housing body 209. In this embodiment dissipating means 255 comprises plate 202 and terminal means 204 as well as rivet 207 and the metal parts connected to them. Preferably resistor 200 is 0.450 inches high, 0.710 inches in diameter with a 0.360 diameter bore 232 and 0.638 inches between flats 233 and 234. Flanges 224 and 225 of plate 202 are about 0.150 inches high and 0.550 inches wide and opening 228 is about 0.130 inches in diameter. Opening 217 is about 0.355 inches in diameter with tabs 218 and 219 about 1/16 inches wide. Flanges 214 and 215 are about 0.150 inches high and 0.550 inches wide. Terminal 211 is about 0.425 inches long from the bend 258 and about ¼ inches wide. Terminal means 204 and plate 202 are about 0.032 inches thick. Seat 240 is about 0.1 inches high or sufficient to provide clearance between terminal means 204 and its neighbor terminal 280. Other dimensions are obtainable from those given and the drawings, or are conventional.

The housing 30 is preferably molded in one piece from phenolic or other suitable plastic although seat 163 and post 68 could be formed of separate pieces of phenolic or other suitable plastic. The terminal means 40 and 134 and heat dissipation members 55 and 131 are preferably made of 0.032 inch thick Olin Corporation Alloy No. 260 brass or similar material. Terminal means 204 and plate 202 are preferably made of 0.032 inch thick Olin Corporation Alloy No. 110 copper. The resistors 25 and 125 are preferably carbonaceous organic resistors having a brass coating on the contact surfaces although other leadless resistors may be used.

It is a feature of the invention that the voltage dropping resistor is a leadless resistor. Further it is a feature of the invention that the heat dissipating means 50, 130, and 255 are formed from the feed-through, terminal straps and terminals which also perform other conventional functions in the timer. This combination permits the resistor and its connection to dissipate the relatively large heat associated with the voltage dropping function and still be price competitive with the prior art. The heat dissipation parts are raised 50° to 60° C. over ambient temperatures by the heat dissipated, and thus conventional resistors and resistor connections are not adequate.

Another feature of the invention is that the locations of the voltage dropping resistors 25, 125 and 200 are much closer to the terminals which are to be connected to the wiring harness. This makes it easier to view the terminals and resistor all at once and to make sure that the resistor is in place and the harness is connected to the proper terminal in the process of assembling the dryer. This eliminates many of the costly mistakes associated with the prior art.

A further feature of the invention is that the resistors 25, 125, and 200 are of the same order of size as the timer and the parts of which it is composed and thus the whole assembly lends itself to be automatically assembled with the usual automated assembly equipment available to assemble timers. This further ensures against error and lower costs.

There has been described a novel dryer timer that incorporates the voltage dropping resistor that allows a timer motor to be operated at two widely differing voltages into the timer and has numerous other features and advantages. It is evident that those skilled in the art may now make many uses and modifications of the specific embodiment described without departing from the inventive concepts. For example, the invention can be applied in any timer in which an exterior resistor is added for voltage dropping purposes although it is particularly useful when large energies need to be dissipated. Other types of materials or other timer circuits may be employed. Consequently, the invention is to be construed as embracing each and every novel feature and novel combination of features present in the timer described.

What is claimed is:

1. A dryer timer comprising a housing:

a motor;

cam means driven by said motor and carried in said housing;

heat dissipating means carried on said housing;

a leadless resistor in thermal contact with said heat dissipating means;

electrical switch means carried in said housing and responsive to said cam means for causing electrical current passing through said motor to pass through said resistor when in a first position and to pass through another circuit, not including said resistor, when in a second position;

an electrical feed-through connected to said switch, passing through said housing; and electrically connected to said resistor; and an electrical terminal means carried on said housing for connecting said resistor to the heater circuit of a dryer.

2. A dryer timer as in claim 1 wherein at least a portion of said heat dissipating means is integrally formed with said terminal means.

3. A dryer timer as in claim 2 wherein said heat dissipating means further includes a means for clasping said resistor between said portion integrally formed with said terminal means and said feed-through.

4. A dryer timer as in claim 3 wherein said resistor comprises a slug having a pair of parallel, substantially flat sides.

5. A dryer timer as in claim 1 wherein said feed-through comprises a means for attaching at least a portion of said heat dissipating means to said housing.

6. A dryer timer as in claim 4 wherein said feed-through comprises a rivet.

7. A dryer timer as in claim 1 wherein said resistor comprises an organic resistor.

* * * * *

UNITED STATES PATENT AND TRADEMARK OFFICE

CERTIFICATE OF CORRECTION

PATENT NO. : 4,868,997

DATED : September 26, 1989

INVENTOR(S) : Steven W. Smock; Ross G. Helft

It is certified that error appears in the above—identified patent and that said Letters Patent is hereby corrected as shown below:

On the title page:

The last name of the second inventor should be Helft.

Signed and Sealed this

Fourteenth Day of August, 1990

*Attest:*

HARRY F. MANBECK, JR.

*Attesting Officer*

*Commissioner of Patents and Trademarks*